United States Patent [19]

Roueche et al.

[11] Patent Number: 5,074,671

[45] Date of Patent: Dec. 24, 1991

[54] MIXING APPARATUS

[75] Inventors: W. R. Roueche, Ottawa; T. Van Humbeck, Manotick, both of Canada

[73] Assignee: Dew Engineering and Development Limited, Ottawa, Canada

[21] Appl. No.: 612,226

[22] Filed: Nov. 13, 1990

[51] Int. Cl.[5] ..... B01F 7/16; B01F 15/02

[52] U.S. Cl. ..... 366/172; 366/171; 366/173

[58] Field of Search ..... 366/168, 167, 169, 170, 366/171, 172, 173, 174, 177

[56] References Cited

U.S. PATENT DOCUMENTS 3,186,803 6/1965 Akaboshi ..... 366/168

4,666,669 5/1987 Mumaw ..... 366/172

4,746,222 5/1988 Cobb ..... 366/172

*Primary Examiner*—Robert W. Jenkins

*Attorney, Agent, or Firm*—George A. Seaby

[57] ABSTRACT

Conventional devices for mixing liquids include a container and some form of stirrer for one stage mixing. A two stage mixer for producing a homogeneous emulsion includes a container, a stirrer, and a preliminary mixer in the form of an arcuate plate defining a target above the stirrer. The two liquids are injected into the container through orifices, which are suitably oriented that the liquid streams converge to meet at the target. Thus, preliminary mixing of the liquids occurs at the target, and the liquids fall to the bottom of the container where the mixing process is completed by the stirrer.

6 Claims, 1 Drawing Sheet

MIXING APPARATUS

BACKGROUND OF THE INVENTION

1. Field of the Invention

This invention relates to a mixing apparatus, and in particular to a two stage apparatus for continuously mixing liquids to produce a homogeneous emulsion.

While the apparatus was designed specifically to produce emulsions by mixing an aqueous slurry and an organic solvent, it will be appreciated that the apparatus can be used to mix other ingredients. By "liquids" is meant water, organic solvents and slurries. For example, an aqueous slurry and an organic slurry (an organic solvent with a suspended solid) can be mixed using the apparatus of the present invention.

2. Discussion of the Prior Art

In general, existing mixing devices are single stage mixers including a stirrer. Often, such devices are not sufficiently efficient to produce homogeneous emulsions or at least not in a reasonable period of time.

Searches in the patent literature disclose Canadian Patents Nos. 536,106, which issued to J.A. Carver et al on Jan. 22, 1957 and 817,797, which issued to J.F. Gurley, Jr. on July 15, 1969, and U.S. Pat. No. 3,425,669, which issued to P.G. Gaddis on Feb. 4, 1969, which have elements in common with the invention described herein. However, like the conventional mixer described above, the patented devices are single stage mixers relying, for example on somewhat complicated stirrers to effect mixing. Moreover, existing mixers for producing aqueous slurries usually include a large tank for batch processing of slurries, i.e. for preparing one large batch of slurry at a time. The slurry is produced, the tank is emptied and the process is repeated.

GENERAL DESCRIPTION OF THE INVENTION

An object of the present invention is to solve the problems of existing mixers by providing a relatively simple, two stage mixing apparatus which can be used to produce a homogeneous emulsion quickly.

Another object of the present invention is to provide a two stage mixing apparatus, which can operate continuously, and which therefore is relatively compact.

Accordingly, the present invention relates to an apparatus for mixing liquids comprising container means defining a mixing chamber for receiving the liquids; target means in said chamber; a plurality of inlet means for introducing liquids into said mixing chamber proximate the upper end thereof, said inlet means being adapted to spray the liquids into contact with each other for substantially simultaneous, overlapping impingement upon said target means to initiate mixing of the liquids; and mixer means in said chamber for completing the mixing of the liquids falling beneath said target means.

BRIEF DESCRIPTION OF THE DRAWINGS

The invention will be described in greater detail with reference to the accompanying drawing, which illustrates a preferred embodiment of the invention, and wherein.

DESCRIPTION OF PREFERRED EMBODIMENT

Figure 2:
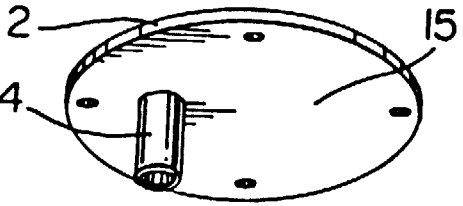
FIG. 2 is a perspective view from below of a cover used in the mixing apparatus of FIG. 1.

With reference to the drawing, the mixing apparatus of the present invention includes a container generally indicated at 1 and a cover 2 for closing the top end thereof. The container 1 is defined by a cylindrical side wall 3 and a circular bottom wall 4. The cover 2, the side wall 3 and the bottom wall 4 define a mixing chamber for receiving an organic solvent and a slurry. The solvent and the slurry are introduced into the mixing chamber via a pair of inlet pipes 6 and 7, and nozzles 8 mounted in the side wall 3.

Figure 3:
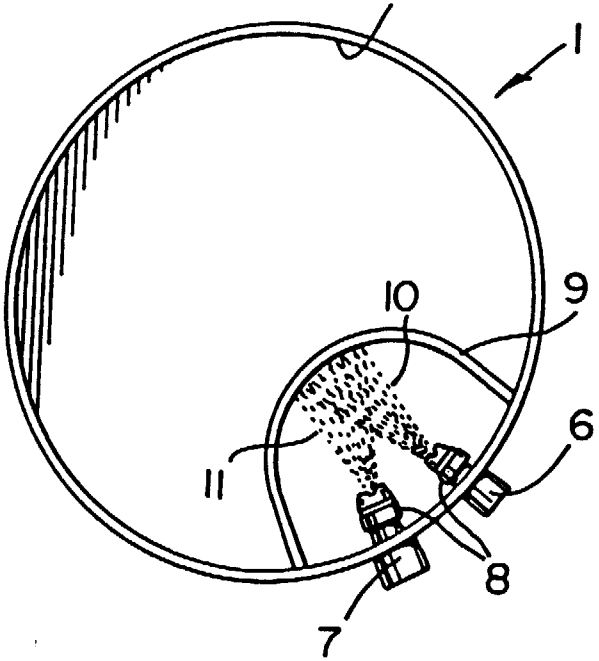
FIG. 3 is a plan view of a container used in the mixing apparatus of FIG. 1.
Figure 1:
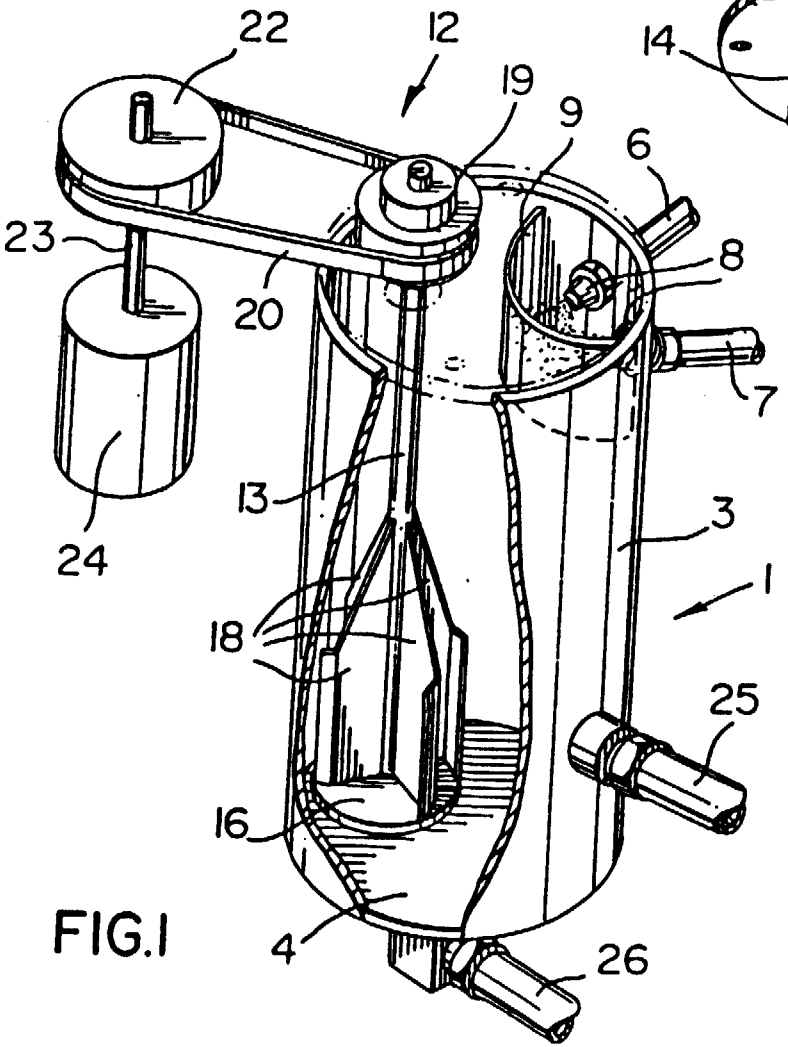
FIG. 1 is a schematic, partly sectioned, isometric view of a mixing apparatus in accordance with the present invention.

A target in the form of an arcuate plate 9 is mounted in the container 1. The plate 9 is generally U-shaped in cross section, or when viewed from above or below. The ends of the plate 9 are welded to the side wall 3 extending around the nozzles 8. The nozzles 8 and the orifices therein (not shown) are oriented in such a manner that their longitudinal axes and those of the streams 10 and 11 (FIG. 3) of liquid sprayed into the chamber intersect at the inner surface of the bight of the U defined by the plate 10, i.e. at the location where the two liquid streams impinge upon the plate 9. The impingement of overlapping streams of liquid before and upon contacting the plate 9 results in first stage or initial mixing of the liquids. As best shown in FIG. 3, the streams 10 and 11 come into contact with each other before reaching the plate 9, and mixing begins immediately.

The thus mixed liquids fall to the bottom of the container for second stage mixing, which is effected by a stirrer generally indicated at 12. The stirrer 12 includes a shaft 13 rotatably mounted in a sleeve 14 (FIG. 2) extending downwardly from the circular plate 15 defining the cover 2. The shaft 13 carries a circular bottom plate 16 and a plurality of radially extending blades or vanes 18 on the plate 16. A pulley 19 is mounted on the top end of the shaft 13 above the cover 2. The pulley 19 is rotated by a belt 20 and a second, larger pulley 22, which is mounted on the shaft 23 of a motor 24.

The emulsion produced in the container is discharged therefrom via an outlet pipe 25 in the side wall 3 near the bottom end of the container. During normal operation, with the lid 2 secured to the top of the container 1, the liquids are injected under pressure. Thus, the mixing process is carried out under pressure, whereby relatively small volumes of liquid are continuously mixed and discharged from the container 1 through the pipe 25. A drain 26 is provided in the bottom wall 4 for emptying the container.

Thus, there has been described a relatively simple mixing apparatus for effective two stage mixing, the first stage occurring when two liquids are injected into the container 1 under pressure and impinging on the plate 9 defining the target, and the second stage involving stirring with the stirrer 11.

What is claimed is:

1. An apparatus for mixing liquids comprising container means defining a mixing chamber for receiving the liquids; target means in said chamber; a plurality of discrete inlet means for introducing liquids into said mixing chamber at spaced apart locations proximate the upper end thereof, said inlet means being adapted to spray the liquids into contact with each other at said target means for substantially simultaneous, overlapping impingement upon said target means to initiate mixing of the liquids, and mixer means in said chamber for completing the mixing of the liquids falling beneath said target means.

2. An apparatus according to claim 1, wherein said container means includes side walls means; and said target means ia arcuate plate means with a vertical axis of curvature spaced apart from said side wall means in the area of said inlet means, said inlet means being adapted to spray the liquids against a curved portion of said plate means.

3. An apparatus according to claim 2, wherein said side wall means is cylindrical, and said plate means is U-shaped, the plate means being connected to said side wall means on each side of said inlet means and curving inwardly towards the center of the container means.

4. An apparatus according to claim 1, 2 or 3, wherein said mixer means is a mechanical stirrer.

5. An apparatus according to claim 2, wherein said inlet means includes a pair of nozzle means in said side wall means, the longitudinal axes of said nozzle means intersecting proximate one location on said target means, whereby to promote mixing of liquids before and during impinging upon said target means.

6. An apparatus according to claim 5, wherein said plate means is generally U-shaped in cross section, said one location being at the inner centre of the bight of the U.

* * * * *